US006063011A

United States Patent [19]

Pelchat

[11] Patent Number: 6,063,011

[45] Date of Patent: May 16, 2000

[54] MARTIAL ARTS TRAINING DEVICE

[76] Inventor: William S. Pelchat, 20 Overbrook Rd., Pembroke, Mass. 02359

[21] Appl. No.: 09/229,415

[22] Filed: Jan. 12, 1999

Related U.S. Application Data

[60] Provisional application No. 60/072,012, Jan. 21, 1998.

[51] Int. Cl.[7] ..... A63B 69/00

[52] U.S. Cl. ..... 482/83; 87/90

[58] Field of Search ..... 482/83–90; 473/441–445

[56] References Cited

U.S. PATENT DOCUMENTS

| | | | |
|---|---|---|---|
| 1,685,495 | 9/1928 | Latz | 482/87 |
| 4,572,504 | 2/1986 | DiBartolo . | |
| 4,817,941 | 4/1989 | McCorry . | |
| 4,946,159 | 8/1990 | Jones . | |
| 5,183,450 | 2/1993 | Stelmach . | |
| 5,281,191 | 1/1994 | DeSousa . | |
| 5,700,230 | 12/1997 | Cardona | 482/83 |
| 5,800,319 | 9/1998 | Choate | 482/83 |
| 5,902,217 | 5/1999 | Schechnex et al. | 482/83 |

*Primary Examiner*—Jerome Donnelly
*Attorney, Agent, or Firm*—D. Michael Burns

[57] ABSTRACT

A portable martial arts training device having the ability to be removably attached to a support structure such as a heavy punching bag or another verticle support structure like a tree. The device has a main body, which after being strapped to a vertical support such as a heavy punching bag, can be used to absorb kicks and punches. A plurality of cylindrical targets, extend from and are horizontally supported by the main body, and simulate human arms and legs. These targets are removably and multipositionally connected to the main base. The targets can be unmounted, then wrapped within the base, and the entire device fastened by straps thus allowing the device to be transported by the practitioner as would a duffle bag.

8 Claims, 4 Drawing Sheets

MARTIAL ARTS TRAINING DEVICE

CROSS REFERENCE TO RELATED APPLICATION

This application is based on Provisional Patent Application Ser. No. 60/072,012, filed Jan. 21, 1998.

BACKGROUND OF THE INVENTION

1. Field of the Invention

The present invention relates generally to the field of martial arts training devices and particularly to devices that are easily disassembled and portable.

2. Description of the Prior Art

Martial arts is increasing in popularity and in every city there are numerous schools teaching kickboxing or the oriental arts of karate, judo, tae kwon do and the like. To practice these forms of self defense is difficult against a live opponent, because the kicks and blows must be done at partial speed and the punches pulled to prevent injury to the opponent. The danger of injury is very realistic in face to face sparring, and it is therefore beneficial to practice without an opponent. The problem with the lack of a real opponent, is in simulating actual sparring conditions.

The prior art has addressed the problem utilizing many different kinds of targets and devices which can safely absorb the punches and kicks during training, while eliminating the need for another person being involved. Devices have been proposed to substitute for another person. One such device is described in U.S. Pat. No. 4,817,941 issued to McCarry on Apr. 4, 1989, whereby an adjustable target holder is used. This is a horizontally supportive structure whereby an object to be struck can be held at various height levels. Unlike the present invention this invention is not geared to the delivery of multiple blows simultaneously to multiple targets. McCarry's invention is portable in that it is on wheels, however it is not as portable as is the present invention which can be carried as easily as if it were a duffle bag.

U.S. Pat. No. 4,946,159 issued to Jones on Aug. 7, 1990, teaches a martial arts training device with reactive areas. While Jones shows multiple arms that react to allow the striker to practice his defense as well as offense, he does not describe a device that could be easily transported. It would involve more secure attachment means and would not lend itself to being carried into a gymnasium or taken into the back yard to be strapped to a tree.

U.S. Pat. No. 4,572,504 issued to DiBartolo on Feb. 25, 1986, teaches a holder for karate boards and shows a device that can easily be strapped to a verticle type support such as a heavy punching bag. But unlike the present invention the device here is limited to holding flat planar type objects and does not allow for the sparring against a target simulating legs, arms and torso of an opponent.

DeSousa teaches in U.S. Pat. No. 5,281,191 issued in Jan. 25, 1994, a striking dummy which is very portable and could be used on many vertical supports. It does not teach any convenient carrying mechanism as does the present invention. It is also more suited for the training of boxing since it does not have any provisions for allowing kicking or karate type blows.

Stelmach teaches a martial arts training apparatus in U.S. Pat. No. 5,183,450 issued of Feb. 2, 1993. His apparatus is a heavy punching bag and has straps to affix it to the bag. The limiting feature of this very portable invention is that it addresses only the need to practice kicks. It would be virtually unrealistic to practice anything but kicks with it.

None of the above inventions and patents, taken either singly or in combination, is seen to describe the instant invention as claimed.

SUMMARY OF THE INVENTION

The present invention is a martial arts training device with a rectangular base, which can be padded and also can be fastened by one or more straps to a vertical support such as a heavy punching bag or even a tree. One or more flexible, horizontally supported, shock absorbent limbs, made up of one or more cylindrical pads, are removably and multi-positionally connected to the base. These pads and the base are used as targets for punches and kicks thrown by the martial arts practitioner. The cylindrical targets can be quickly disassembled and placed within the main base, which is then wrapped around the targets. The entire ensemble tightly secured by straps for easy transportation.

Accordingly, it is a principal object of the invention to provide a training device for practicing the delivering of punches and kicks.

It is another object of the invention to provide a training device requiring no other people than the practitioner, thereby allowing him to be able to deliver all blows at maximum force.

It is a further object of the invention to provide a training device whereby one or more targets can be positioned at multiple angles. These targets being flexibly and shock absorbently coupled together to simulate movement as would a human limb if it were struck in a similar fashion.

Still another object of the invention is to provide a training device that can be utilized just about anywhere that a vertical support is available, such as a heavy punching bag at the local gymnasium or a tree in the back yard.

It is an object of the invention to provide a training device that can be as easily transported as that of carrying a duffle bag.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
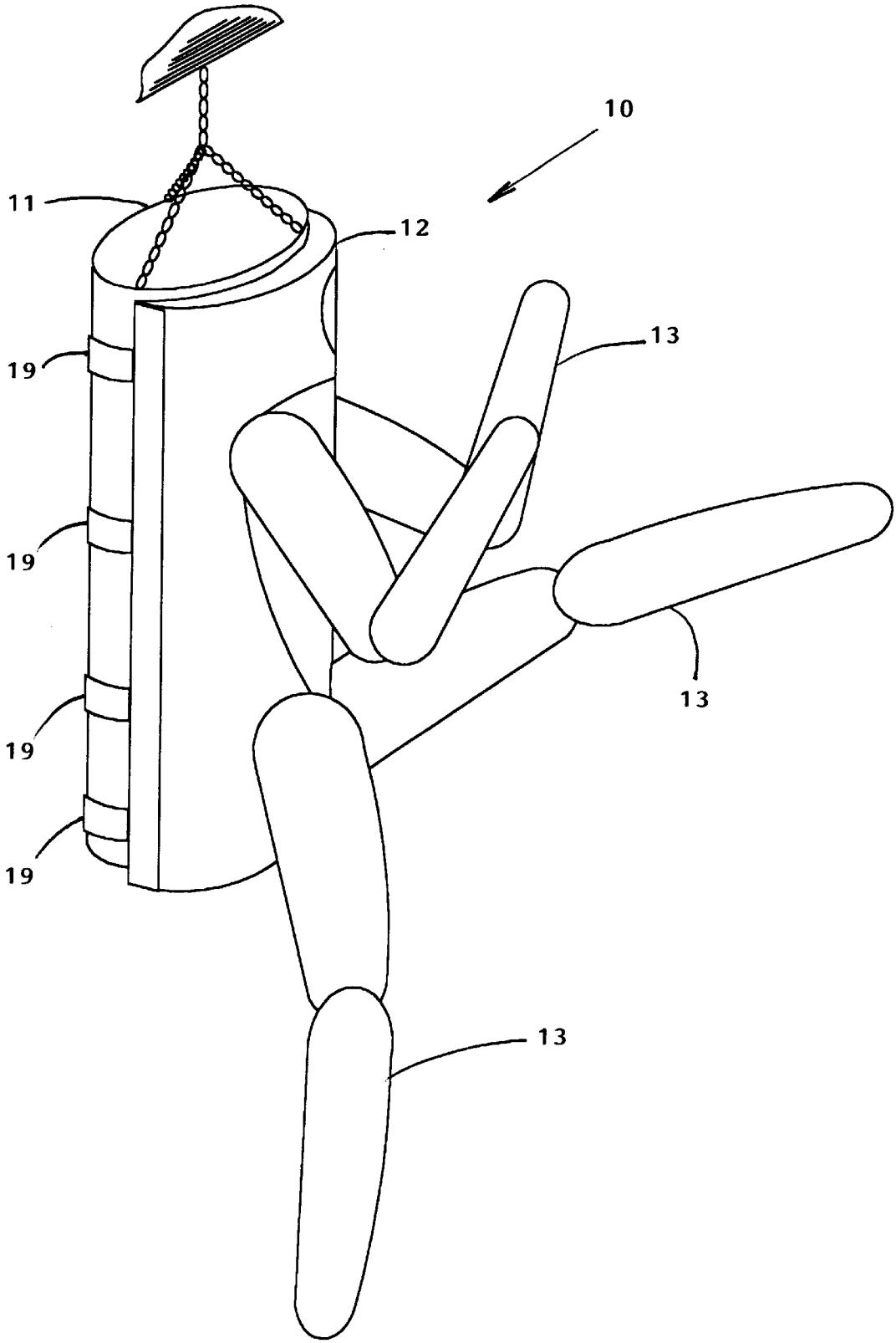
FIG. 1 is an elevated environmental view of the device attached to a punching bag.

Referring to the drawings, the invention provides for a martial arts training device 10 that can be mounted on a vertical supporting structure 11 such as a heavy punching bag as shown in FIG. 1. The device 10 includes a base target member 12 which is made up of a generally rectangular shaped pad 14. The pad 14 is filled with a resilient padding 30 made from a high impact absorbent material such as foam, liquid, air or any other conventional means that will withstand the shock from punches and kicks by the practitioner. Although there are some padding materials 30 that would not require an outer covering, it is anticipated that commonly used materials such as canvas, leather, polyethylene or nylon type plastic be employed. One embodiment of the invention would utilize the device 10 strictly in conjunction with a heavy punching bag 11, which would not require the pad 14 to have padding 30, since the bulk of the bag 11 itself would absorb the impact of the punches and kicks. In the preferred embodiment, the base target member 12 is filled with a high impact resisting padding 30 made of foam.

Figure 2:
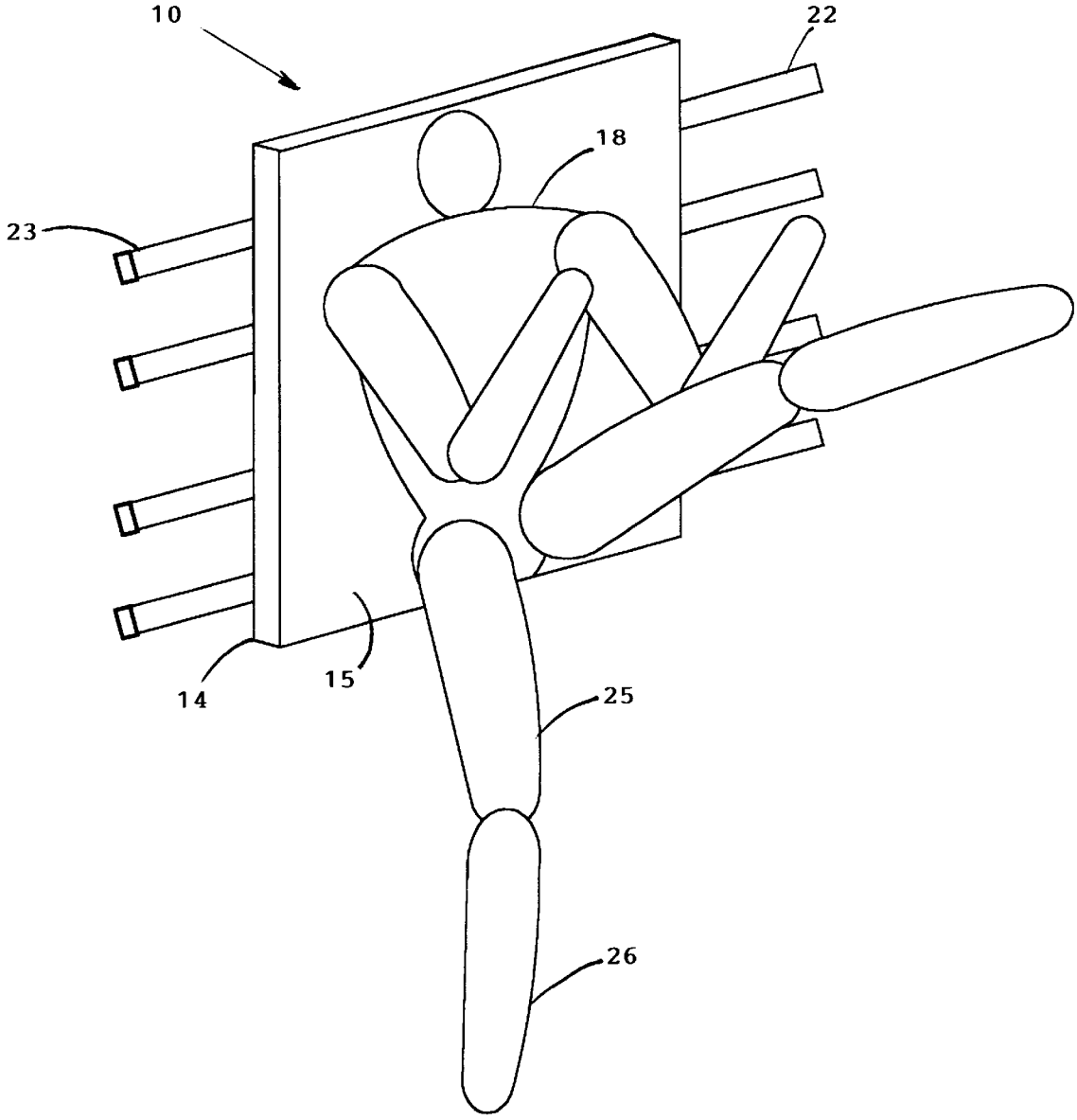
FIG. 2 is a pictorial front view of the device illustrating the appendage targets and indicia.

FIG. 2 depicts the front surface 15 of the base target member 12 and shows a plurality of fixed securing anchors 38 interposed between the front surface 15 and a back surface 16 of the pad 14. Each anchor 38 is positionally and rotatably coupled to an appendage target 13 by a revertible connector 43. Each appendage target 13 is comprised of limb like members; an inner limb target 25 and an outer limb target 26. These limbs 25, 26 will simulate to the practitioner the actual arms and legs of a real opponent. The front surface 15 of the pad 14 will have indicia 18 simulating, for target purposes, the outline of an opponent's head and torso.

Figure 3:
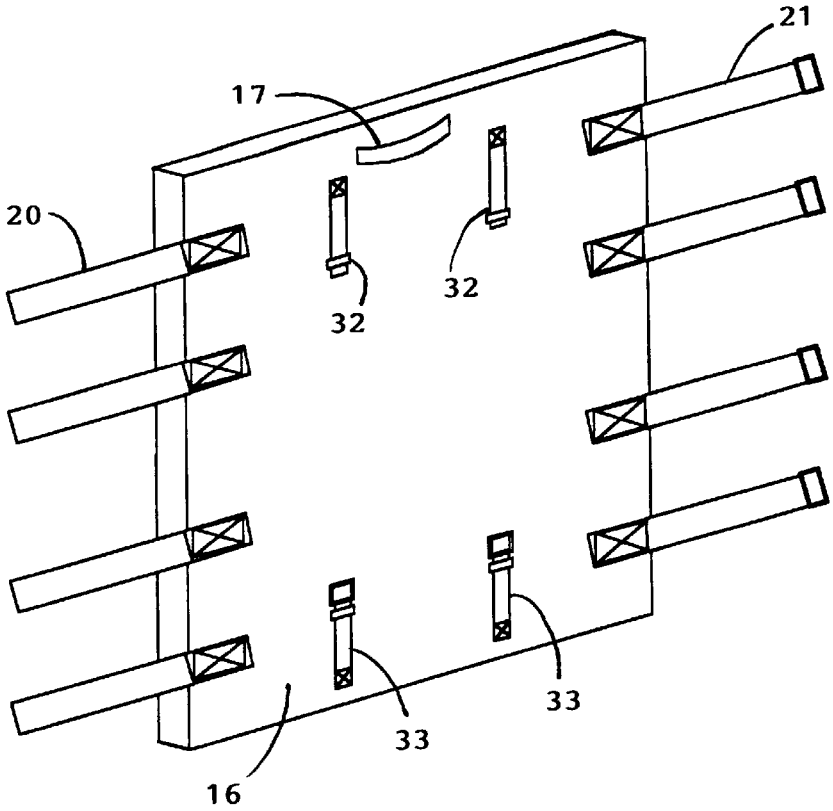
FIG. 3 is a pictorial rear view of the device of the straps and handle.
Figure 4:
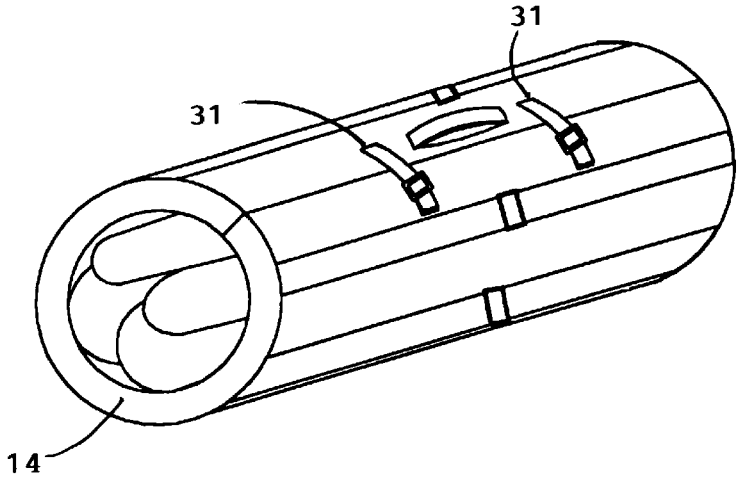
FIG. 4 is a pictorial view of the appendage targets disassembled and wrapped up within the pad.

FIG. 3 illustrates the back surface 16 of the pad 14. The pad 14 having a plurality of straps integrally and spacially deposed therein. One group of straps being attaching straps, 19 which encircle the supporting structure 11 and then attach the device 10 to it. The other straps are fastening straps 31 and they are employed to fasten the device 10 for transport as shown in FIG. 4. The attaching straps 19 consist of two nylon strips, a leading edge strip 20 and an attaching strip 21. Both strips 20, 21 have one end integral with the back surface 16. The attaching strip 21 has a buckle 23 at its opposite end, while the leading edge strip has a distal end 22 for coupling with the buckle end 23. The fastening straps 31, although much shorter, operate in the same manner as the attaching straps 19. These straps 31 are made up of a male end 32 and a female end 33. It is to be appreciated that in lieu of nylon the strips can be canvas, leather or some other plastic material such as vinyl. Instead of a strap and buckle arrangement, hook and loop fasteners, such as those sold under the Velcro trademark, would work equally as well. A handle 17 is deposed on the back surface 16 and is discussed further in the disclosure.

Figure 5:
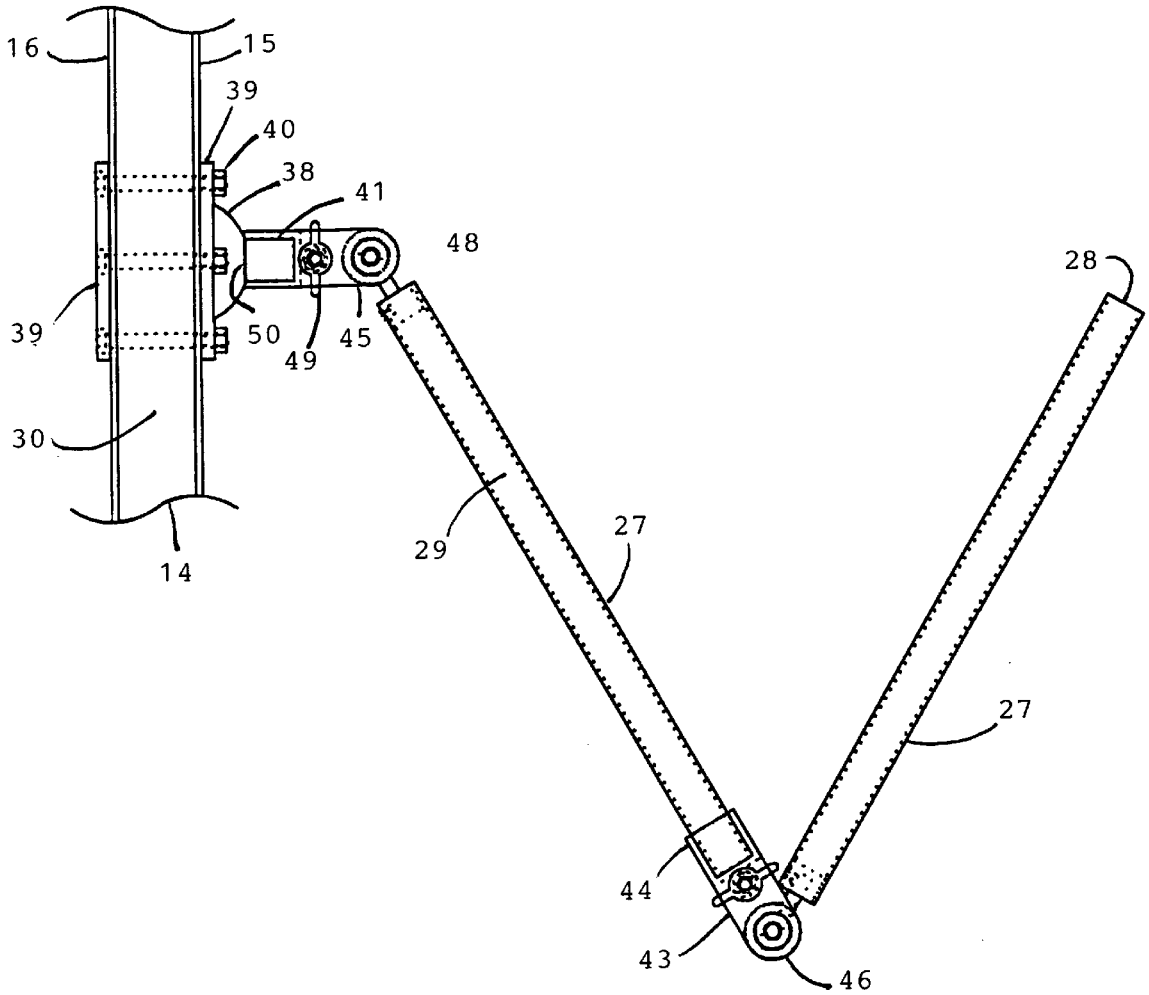
FIG. 5 is a pictorial view of the support rods, fixed securing anchors and revertible connectors.

The limbs 25, 26 of the appendages each have a longitudinal and coaxially disposed support rod 27 contained therein. FIG. 5 depicts the rods 27 having opposite ends, a socket end 29 for engaging one side of the revertible connector portion 43 and a distal end 28 for engaging the opposite side of another revertible connector 43. These rods 27 will be wrapped with an impact absorptive material 30 as discussed for the pad 14 above. The limbs 25, 26 will also be covered with similar nylon, vinyl, leather, or canvas materials as those that would cover the pad 14.

The revertible connector 43 is an elongate hollow cylinder 44 comprised of two semi-concentric portions 45. A wing type bolt/nut connection 49 holds the semi-concentric portions 45 together. At one end of the cylinder 44 there is contained a rubber like sleeve 46 which gives the limbs 25, 26 their deflective and revertible qualities. The sleeve 46 having a nipple like end 48 protruding outwardly from its center, therein engaging the socket end 29 of the support rod 27. At the other end of the cylinder 44 is a socket 50 for slip-fitting over either the distal end 22 of the support rod 27 or for mounting to the fixed securing anchor 38.

The fixed securing anchors 38 are comprised of a pair of opposing brackets 39. The brackets 39 are placed in a parallel relationship, on opposing front and back surfaces 15, 16, then are coupled by bolts and nuts 40. The bracket 39 on the front surface 15 has a longitudinally extending concentric mount 41 which is similar to the distal end of the support rod 27. The opening 50 of the revertible connector 43 will slip-fit in a removable, rotational engaging manner with the mount 41, thereby allowing the appendage targets to be horizontally and positionally supported. The practitioner can then deliver kicks and punches and the like, as if there were a live opponent and the limbs 25, 26 would react as would human limbs.

When the device 10 is to be transported, the appendages 13 are disconnected from the base target 12 and then placed in an axial relationship to each other within the front surface 15 of the wrapped up base target 12. The device 10 is then fastened by buckling the fastening straps 31. FIG. 5 shows the device 10 ready for transport by the practitioner. The fastened device 10 is in the shape of a duffle bag and is carried with the handle 17.

In the preferred embodiment the device 10 will utilize four appendage targets 13 to simulate the human arms and legs. The device will further employ four pairs of attaching straps 19, and two pair of fastening straps 31.

It is to be understood that the present invention is not limited to the sole embodiment described above, but encompasses any and all embodiments within the scope of the following claims.

I claim:

1. A portable martial arts training device designed to be removably attachable to a support structure for use in the practice of martial arts techniques comprising:

a base target member, the base target having a generally rectangular pad, the pad having a filling of impact absorbing material, the pad having a front surface and a back surface, the surfaces in a generally parallel relationship to each other, the front surface having indicia depicting a human head and torso;

means for attaching the base target member to the support structure;

a plurality of appendage targets for emulating human limbs, each appendage target consisting of an inner limb and an outer limb, a support rod coaxial and cointensive interposed within each limb, the support rod wrapped with an impact absorbing material;

means of anchoring the appendages to the pad;

each appendage having a pair of revertible connectors, one revertible connector coupling the two support rods to each other, the other revertible connector mounting the support rod of the inner limb to the anchoring means of the pad;

means for fastening the device for transportation; and a handle integral with the back surface of the pad for carrying the device.

2. The device according to claim 1, wherein the anchoring means for mounting the appendages to the pad comprises:

a plurality of fixed securing anchors, each anchor having a pair of brackets in a generally parallel relationship to each other, one bracket on the front surface of the pad and the other bracket on the back surface of the pad, the brackets held together by a plurality of conventional bolt and nut arrangements, the bracket on the front surface having an elongated concentric mount extending outwardly thereof for accepting the appendage.

3. The device according to claim 2, wherein the revertible connector includes:

an elongated hollow cylinder being comprised of two concentric half portions, the portions held together by a conventional bolt and wing nut;

a rubber like sleeve integral at one end of the cylinder, the sleeve providing the deflective and revertible quality to the limbs, the sleeve having a nipple part protruding outwardly for attachment to the support rod; and the other end of the cylinder defining a socket therein, the socket capable of accepting either the concentric mount of the bracket or the support rod.

4. The device according to claim 3, wherein attaching means comprises a plurality of straps having one end fastened to the back surface of the pad and after encircling the support structure are attached by conventional buckling.

5. The device according to claim 4, wherein the fastening means comprises at least one strap, whereby the appendages can be removed and stored within the rolled up pad, then fastened by buckling the strap.

6. The device according to claim 5, wherein the resilient impact material of the pad and appendages is a foam.

7. The device according to claim 6, wherein the covering material for the device is vinyl.

8. The device according to claim 6, wherein the covering material for the device is canvas.

* * * * *